US011603978B2

(12) United States Patent
Menn et al.

(10) Patent No.: US 11,603,978 B2
(45) Date of Patent: Mar. 14, 2023

(54) AUTOMOTIVE LIGHTING DEVICE AND METHOD FOR CONTROLLING AN ELEMENT THEREOF

(71) Applicant: VALEO VISION, Bobigny (FR)

(72) Inventors: Thibaut Menn, Bobigny (FR); Cedric Merlin, Bobigny (FR); Christine Roucoules, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/415,514

(22) PCT Filed: Dec. 5, 2019

(86) PCT No.: PCT/EP2019/083871
§ 371 (c)(1),
(2) Date: Jun. 17, 2021

(87) PCT Pub. No.: WO2020/126526
PCT Pub. Date: Jun. 25, 2020

(65) Prior Publication Data

US 2022/0042668 A1 Feb. 10, 2022

(30) Foreign Application Priority Data

Dec. 20, 2018 (EP) ..... 18214731

(51) Int. Cl.
*F21S 45/30* (2018.01)
*F21S 45/33* (2018.01)
*F21S 45/47* (2018.01)

(52) U.S. Cl.
CPC ..... *F21S 45/33* (2018.01); *F21S 45/47* (2018.01)

(58) Field of Classification Search
CPC ..... F21S 45/33; F21S 45/47; F21S 48/335; F21S 48/30; F21S 48/31; F21S 45/10;
(Continued)

(56) References Cited

U.S. PATENT DOCUMENTS 5,251,111 A * 10/1993 Nagengast ..... F21S 45/33 362/547
7,217,314 B2 * 5/2007 DeGuiseppi ..... B01D 53/28 362/547

(Continued)

FOREIGN PATENT DOCUMENTS

DE 11 2012 006 405 T5 2/2015
DE 10 2017 105 816 A1 9/2018

(Continued)

OTHER PUBLICATIONS

International Search Report dated Feb. 14, 2020 in PCT/EP2019/083871 filed on Dec. 5, 2019.

*Primary Examiner* — Omar Rojas Cadima
(74) *Attorney, Agent, or Firm* — Oblon, McClelland, Maier & Neustadt, L.L.P.

(57) ABSTRACT

An automotive lighting device including a light source, a driver arranged to control the operation of the light source, a housing, a desiccant salt and a separating element. The driver includes a driver cover arranged to dissipate the heat generated by the driver. The housing includes a housing wall and a ventilation element located in the housing wall, the ventilation element being configured to allow water vapour to exit the housing. The desiccant salt is arranged in thermal contact with the driver cover. The separating element is provided between the desiccant salt and the light source. A method for controlling the operation of the separating element is also provided.

20 Claims, 2 Drawing Sheets

(58) Field of Classification Search
CPC ..... F21S 45/30; F21S 45/20; B01D 53/26; B01D 53/30; B01D 53/32; B01D 2257/80; F21V 23/02; G01N 27/407; B60Q 1/04
See application file for complete search history.

(56) References Cited

U.S. PATENT DOCUMENTS

| | | | | |
|---|---|---|---|---|
| 8,827,522 | B2 * | 9/2014 | Yang ..... | B60Q 1/04 362/547 |
| 2005/0157514 | A1 | 7/2005 | Brinkmann | |
| 2015/0070927 | A1 | 3/2015 | Kurahashi et al. | |
| 2018/0073701 | A1 | 3/2018 | Shin et al. | |

FOREIGN PATENT DOCUMENTS

| | | | |
|---|---|---|---|
| EP | 2 306 084 | A2 | 4/2011 |
| JP | 8-195104 | A | 7/1996 |

* cited by examiner

AUTOMOTIVE LIGHTING DEVICE AND METHOD FOR CONTROLLING AN ELEMENT THEREOF

TECHNICAL FIELD

The present invention belongs to the field of lamps for automotive vehicles, and more specifically, to the design of headlamps to avoid fogging in the outer glass.

STATE OF THE ART

Current headlamps have to fulfil different requirements which sometimes involve contradictory design paths. One example of this is related to demisting problems.

Misting is caused when water vapour condenses on the internal surface of a glass. Micro-drops are unaesthetic and affect the light behaviour, so great efforts are put to solve this problem. However, in order to design modern and efficient lighting devices, walls of opaque materials must surround the light source, to avoid light leakage. But these opaque walls are an obstacle for a free path of dry air to reach the glass surface and avoid condensation.

Hence, the better a solution is for avoiding light leakage, the worse for avoiding glass condensation because these opaque walls create a tortuous defogging air path that will have a very low flow rate and, consequently, a very slow defogging velocity.

Some solutions use a desiccant salt which absorbs moisture in the interior of the housing and then is heated to evacuate this water vapour outside the housing. Examples are found in US 2016/363331 A1, which discloses a device for removing moisture from the interior of a housing.

DESCRIPTION OF THE INVENTION

The invention provides a solution for this problem by the provision of an automotive lighting device according to claim 1. Preferred embodiments of the invention are defined in dependent claims.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In this text, the term "comprises" and its derivations (such as "comprising", etc.) should not be understood in an excluding sense, that is, these terms should not be interpreted as excluding the possibility that what is described and defined may include further elements, steps, etc.

In a first inventive aspect, the invention provides an automotive lighting device comprising

- a light source intended to emit light;
- a driver arranged to control the operation of the light source, the driver comprising a driver cover arranged to dissipate the heat generated by the driver;
- a housing comprising a housing wall and a ventilation element located in the housing wall, the ventilation element being configured to allow water vapour to exit the housing;
- a desiccant salt arranged in thermal contact with the driver cover;
- a separating element provided between the desiccant salt and the light source.

The desiccant salt does not need a dedicated heat source to release the moisture, but the driver which is used to manage the operation of the light source generates enough heat to activate the desiccant salt and cause the desorption of the humidity.

In some particular embodiments, the desiccant salt is arranged in direct contact with the driver cover.

Direct contact between the salt and the driver cover allows a better transfer of the heat generated by the driver, thus increasing the drying rate.

In some particular embodiments, the driver is located in contact with the housing wall.

This location allows the desiccant salt to be also close to the housing wall and to the ventilation elements, so that the humidity may exit the housing quickly after being released by the salt.

In some particular embodiments, the driver comprises a heatsink arranged to cover a hole in the housing.

This location ensures an easy replacement of the driver and/or the salt, and reduces the space dedicated to this drying element.

In some particular embodiments, the automotive lighting device comprises more than one driver which are grouped in a driver assembly which comprises a protrusion.

A driver assembly has a greater heat exchange surface, so that the desiccant salt may be distributed on the assembly to increase the desiccant amount, thus increasing the drying rate.

In some particular embodiments, the ventilation element comprises a porous material configured to allow water vapour to exit the housing but prevents liquid water to enter the housing.

This configuration provides a watertight housing, which is useful for some lighting device which must fulfil this type of requirements.

In some particular embodiments, one ventilation element with the porous material is arranged in the bottom part of the housing and the desiccant salt is arranged in contact or at less than 1 cm from the driver cover.

Due to thermodynamics, at bottom of the headlamp, the temperature is theoretically lower, so the air is drier. When heating up the desiccant salt, the humidity rate will increase in the zone surrounding the desiccant salt. As the humidity rate is lower in the engine compartment surrounding the housing, there will be a higher driving force for diffusion from the desiccant zone to the outside of the housing.

In some particular embodiments, the automotive lighting device further comprises channels to dissipate water vapour, wherein the channels are located in the side parts of the protrusion.

In those lighting devices which do not require a complete watertight configuration, the presence of a pipe or channel is used to speed up the dissipation of water vapour.

In some particular embodiments, the separating element is a hatch with an actuator, the actuator being controlled by the driver.

The hatch is a good element to avoid the water vapour being sent back to the interior of the housing when the desiccant salt is activated by heat.

In some particular embodiments, the desiccant salt is one of silica gel, molecular sieves or activated alumina.

These are common examples of desiccant salt, which are useful to trap the vapour molecules and then release them when it is heated.

In some particular embodiments, the driver is arranged vertically.

A vertical location makes it easy for the driver to be part of a vertical heatsink.

The expressions "lower, higher, vertical" are referred to the position of the lighting device in operation. The person skilled in the art identifies these positions and orientations, since the lighting devices may only be installed in one position with respect to the horizontal plane of the ground.

In a second inventive aspect, the invention provides a method of controlling the operation of a separating element comprised in an automotive lighting device according to the first inventive aspect, the method comprising the step of opening the hatch when the lighting device is not being operated.

An intelligent management of the position of the hatch will improve the drying rate. When the lighting device is not operated, there is no need to heat the desiccant salt to expel the humidity from the interior of the lighting device, so the hatch may be open, so that the salt may absorb humidity.

In some particular embodiments, the method further comprises the steps of closing the hatch when the lighting device is starting operation and following a pattern of opening and closing the hatch depending on the speed of an automotive vehicle where the lighting device is installed.

When the vehicle is turned on, the automotive lighting device starts operation, and the mere operation of the DRL generates enough heat in the driver to heat the desiccant salt. A pattern depending on the vehicle speed may take advantage of natural convection cooling due to air speed. At high speed the engine compartment is cooled, so the hatch may be open to catch the humidity inside the headlamp. At low speed, the engine compartment is warm, so the hatch is closed to expel de humidity.

In some particular embodiments, the method further comprises the steps of closing the hatch when the lighting device is starting operation and following a pattern of opening and closing the hatch depending on the ambient temperature.

At rapid drop of external temperature, it is more advantageous to open the hatch to catch the humidity inside the headlamp.

In some particular embodiments, the method further comprises the steps of closing the hatch when the lighting device is starting operation and following a pattern of opening and closing the hatch according to a predetermined cycle.

This saves energy dedicated to control the hatch, since a timer may be installed easily.

In some particular embodiments, the light source is a solid-state light source.

The term "solid state" refers to light emitted by solid-state electroluminescence, which uses semiconductors to convert electricity into light. Compared to incandescent lighting, solid state lighting creates visible light with reduced heat generation and less energy dissipation. The typically small mass of a solid-state electronic lighting device provides for greater resistance to shock and vibration compared to brittle glass tubes/bulbs and long, thin filament wires. They also eliminate filament evaporation, potentially increasing the life span of the illumination device. Some examples of these types of lighting comprise semiconductor light-emitting diodes (LEDs), organic light-emitting diodes (OLED), or polymer light-emitting diodes (PLED) as sources of illumination rather than electrical filaments, plasma or gas.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out. The drawings comprise the following figures.

Elements of the example embodiments are consistently denoted by the same reference numerals throughout the drawings and detailed description where appropriate.

Figure 1:
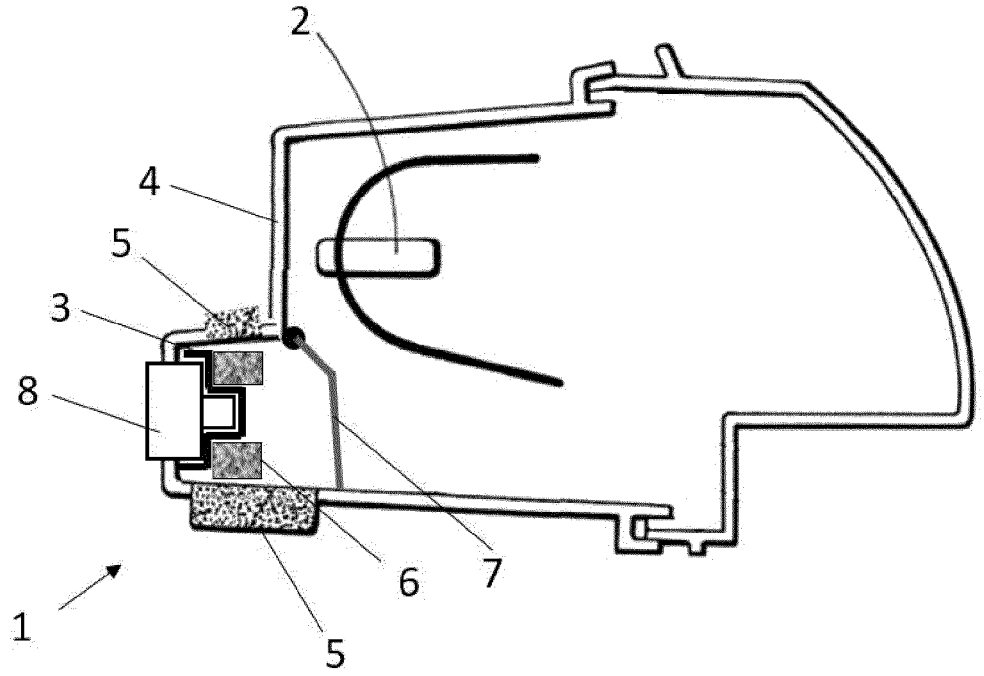
FIG. 1 shows a side scheme of an automotive lighting device according to the invention, when the elements are in a first position.

1 Automotive lighting device
2 Light source
3 Driver cover
4 Housing
5 Ventilation element
6 Desiccant salt
7 Hatch
8 Driver heat sink

DETAILED DESCRIPTION OF THE INVENTION

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

FIG. 1 shows a scheme of an automotive lighting device 1 according to the invention in a first operation mode. This lighting device comprises the following elements:

- a light source 2 intended to emit light;
- a driver assembly arranged to control the operation of the light source 2;
- a housing 4 comprising a housing wall;
- two ventilation elements 5 located in the housing wall;
- a desiccant salt 6; and
- a hatch 7.

The driver assembly comprises a driver cover 3 arranged to dissipate the heat generated by the driver assembly. In this case, it is a metallic layer with a good thermal conductivity, which transfers the heat generated in the driver to the desiccant salt 6 which is located in direct contact with this cover 3. It could be also made of plastic conductive material.

The ventilation elements 5 are configured to allow water vapour to exit the housing 4. It is a porous membrane, so that water vapour is allowed from the housing to the exterior but liquid water may not enter.

The hatch 7 is provided between the desiccant salt 6 and the light source 2, to separate the interior of the housing in two regions, one small region at one side of the hatch 7, which comprises the driver assembly and the desiccant salt 6, and another region which is the rest of the lighting device, comprising the lighting source and the optical and thermal elements.

In this embodiment, the driver assembly also comprises a heatsink 8 arranged to cover a hole in the housing 4. In other embodiments, it is located in contact with the housing wall, so that the region with the driver assembly and the desiccant salt is limited.

The driver assembly comprises a protrusion, to maximize the contact surface between the driver cover 3 and the desiccant salt 6, thus improving the drying rate.

The opening and closing movements of the hatch 7 are driven by an actuator, which is controlled by a dedicated micro-controller. In other embodiments, it is the driver assembly which controls this operations In this FIG. 1, the hatch is open, and therefore the water vapour particles may accede to the zone of the lighting device where the desiccant salt 6 is. The desiccant salt 6 is configured to absorb these particles, so that the humidity inside of the lighting device decreases, and the risk of mist decreases as well.

Figure 2:
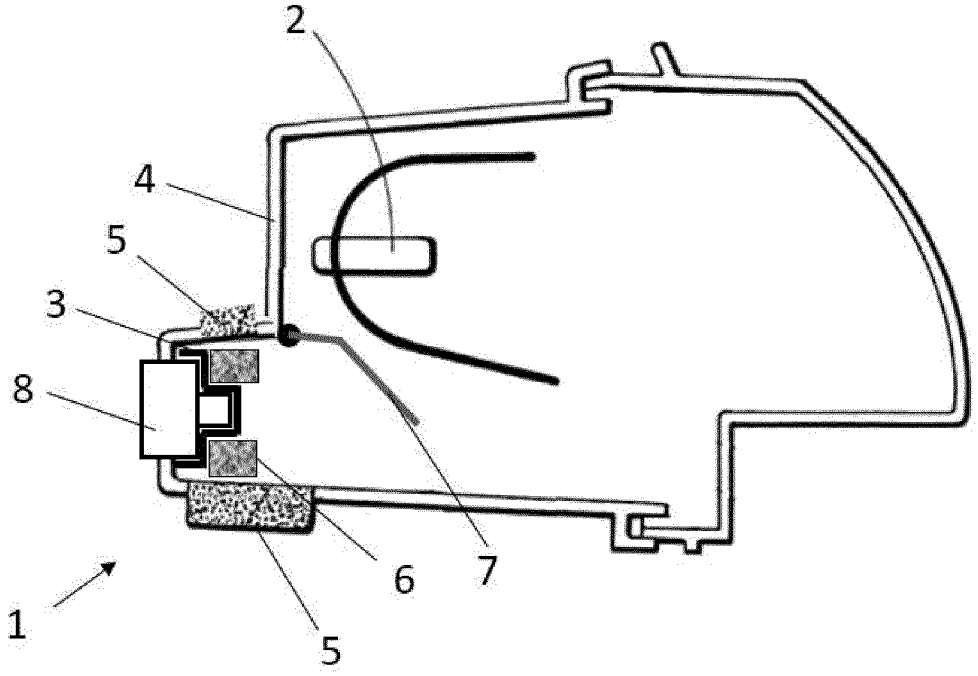
FIG. 2 shows a side scheme of the automotive lighting device of FIG. 1, when the elements are in a second position.

FIG. 2 shows this lighting device 1 in a second position, where the hatch 7 is closed and the desiccant salt 6 is expelling the vapour particles to the exterior of the lighting device through the ventilation means. Some vapour particles exit through the upper ventilation element by convection because they are hotter than the air outside the lighting device, and some of the vapour particles exit the lighting device through the lower ventilation element by diffusion, since the air outside the lighting device is drier in this zone.

Figure 3:
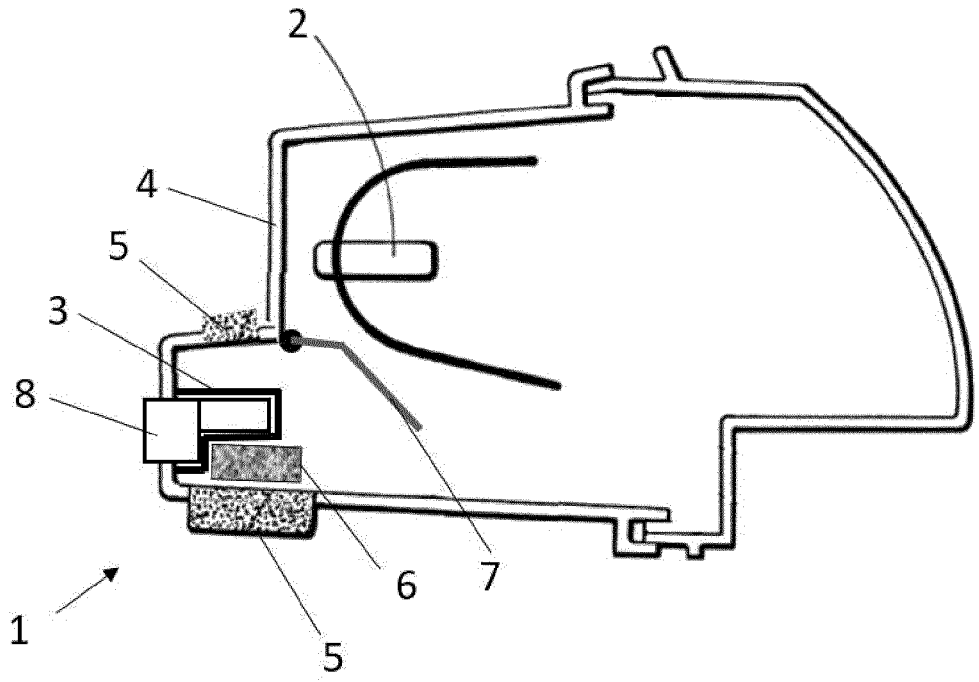
FIG. 3 shows a side scheme of an alternative embodiment of an automotive lighting device according to the invention, when the elements are in a second position.

FIG. 3 shows an alternative arrangement of the element of this lighting device 1. In this case, the driver assembly has a different shape and the desiccant salt is located in the lower portion of the housing. In particular embodiments, the desiccant salt is arranged in contact or at less than 1 cm from the driver cover.

Due to thermodynamics, at bottom of the headlamp, the temperature is theoretically lower, so the air is drier. When heating up the desiccant salt, the humidity rate will increase in the zone surrounding the desiccant salt. As the humidity rate is lower in the engine compartment surrounding the housing, there will be a higher driving force for diffusion from the desiccant zone to the outside of the housing. Diffusion expelling of the water vapour is emphasized with respect to the convection expelling.

As a consequence, the hatch may be controlled according to many different strategies.

When the lighting device is not operated, there is no need to heat the desiccant salt to expel the humidity from the interior of the lighting device, so the hatch may be open, so that the salt may absorb humidity.

When the vehicle is turned on, the automotive lighting device starts operation, and the mere operation of the DRL generates enough heat in the driver to heat the desiccant salt. A pattern depending on the vehicle speed may take advantage of natural convection cooling due to air speed. At high speed the engine compartment is cooled, so the hatch may be open to catch the humidity inside the headlamp. At low speed, the engine compartment is warm, so the hatch is closed to expel de humidity.

As an independent circumstance, this pattern may also depend on ambient conditions. For example, at rapid drop of external temperature, it is more advantageous to open the hatch to catch the humidity inside the headlamp, since the external temperature also affects the temperature inside the housing.

A predetermined cycle may also be used, without taking into account either the humidity or the car speed conditions. This is a cheaper way of controlling, but it is less efficient.

The invention claimed is:

1. Automotive lighting device comprising a light source intended to emit light;

a driver arranged to control the operation of the light source, the driver comprising a driver cover arranged to dissipate the heat generated by the driver;

a housing comprising a housing wall and a ventilation element located in the housing wall, the ventilation element being configured to allow water vapour to exit the housing;

a desiccant salt arranged in thermal contact with the driver cover; and a separating element provided between the desiccant salt and the light source.

2. Automotive lighting device according to claim 1, wherein the desiccant salt is arranged in direct contact with the driver cover.

3. Automotive lighting device according to claim 2, wherein the driver cover is located in contact with the housing wall.

4. Automotive lighting device according to claim 2, comprising more than one driver which are grouped in a driver assembly which comprises a protrusion.

5. Automotive lighting device according to claim 2, wherein the ventilation element comprises a porous material configured to allow water vapour to exit the housing but prevents liquid water to enter the housing.

6. Automotive lighting device according to claim 2, wherein the separating element is a hatch with an actuator, the actuator being controlled by the driver.

7. Automotive lighting device according to claim 2, wherein the desiccant salt is one of silica gel, molecular sieves or activated alumina.

8. Automotive lighting device according to claim 1, wherein the driver cover is located in contact with the housing wall.

9. Automotive lighting device according to claim 1, comprising more than one driver which are grouped in a driver assembly which comprises a protrusion.

10. Automotive lighting device according to claim 9, wherein the ventilation element comprises a porous material configured to allow water vapour to exit the housing but prevents liquid water to enter the housing, the device further comprising channels to dissipate water vapour, wherein the channels are located in the side parts of the protrusion.

11. Automotive lighting device according to claim 1, wherein the ventilation element comprises a porous material configured to allow water vapour to exit the housing but prevents liquid water to enter the housing.

12. Automotive lighting device according to claim 1, wherein the separating element is a hatch with an actuator, the actuator being controlled by the driver.

13. Automotive lighting device according to claim 1, wherein the desiccant salt is one of silica gel, molecular sieves or activated alumina.

14. Automotive lighting device according to claim 1, wherein the driver is arranged vertically.

15. Method for controlling the operation of a separating element comprised in an automotive lighting device according to claim 1, the method comprising the step of opening a hatch when the lighting device is not being operated.

16. Method according to claim 15, further comprising the steps of closing the hatch when the lighting device is starting operation and following a pattern of opening and closing the hatch depending on the speed of an automotive vehicle where the lighting device is installed.

17. Method according to claim 15, further comprising the steps of closing the hatch when the lighting device is starting operation and following a pattern of opening and closing the hatch depending on the ambient temperature.

18. Method according to claim 15, further comprising the steps of closing the hatch when the lighting device is starting operation and following a pattern of opening and closing the hatch according to a predetermined cycle.

19. Automotive lighting device comprising a light source intended to emit light;

a driver arranged to control the operation of the light source, the driver comprising a driver cover arranged to dissipate the heat generated by the driver;

a housing comprising a housing wall and a ventilation element located in the housing wall, the ventilation element being configured to allow water vapour to exit the housing;

a desiccant salt arranged in thermal contact with the driver cover; and a separating element provided between the desiccant salt and the light source, wherein:

the driver cover is located in contact with the housing wall, and the driver comprises a heatsink arranged to cover a hole in the housing.

20. Automotive lighting device comprising a light source intended to emit light;

a driver arranged to control the operation of the light source, the driver comprising a driver cover arranged to dissipate the heat generated by the driver;

a housing comprising a housing wall and a ventilation element located in the housing wall, the ventilation element being configured to allow water vapour to exit the housing;

a desiccant salt arranged in thermal contact with the driver cover; and a separating element provided between the desiccant salt and the light source, wherein:

the ventilation element comprises a porous material configured to allow water vapour to exit the housing but prevents liquid water to enter the housing, and one ventilation element with the porous material is arranged in the bottom part of the housing and the desiccant salt is arranged in contact or at less than 1 cm from the driver cover.

* * * * *